US010760533B2

(12) United States Patent
Nakagawa et al.

(10) Patent No.: US 10,760,533 B2
(45) Date of Patent: Sep. 1, 2020

(54) EVAPORATED FUEL PROCESSING DEVICE

(71) Applicant: AISAN KOGYO KABUSHIKI KAISHA, Obu-shi, Aichi (JP)

(72) Inventors: Makoto Nakagawa, Nagoya (JP); Daisaku Asanuma, Gamagori (JP); Masanori Sugiura, Toyoake (JP)

(73) Assignee: AISAN KOGYO KABUSHIKI KAISHA, Obu-shi, Aichi (JP)

( * ) Notice: Subject to any disclaimer, the term of this patent is extended or adjusted under 35 U.S.C. 154(b) by 0 days.

(21) Appl. No.: 16/607,504

(22) PCT Filed: Apr. 5, 2018

(86) PCT No.: PCT/JP2018/014611
§ 371 (c)(1),
(2) Date: Oct. 23, 2019

(87) PCT Pub. No.: WO2018/198715
PCT Pub. Date: Nov. 1, 2018

(65) Prior Publication Data

US 2020/0141359 A1 May 7, 2020

(30) Foreign Application Priority Data

Apr. 28, 2017 (JP) ..... 2017-090471

(51) Int. Cl.
*F02M 25/00* (2006.01)
*F02M 25/08* (2006.01)
*F02M 69/34* (2006.01)

(52) U.S. Cl.
CPC .... *F02M 25/0818* (2013.01); *F02M 25/0836* (2013.01); *F02M 69/34* (2013.01)

(58) Field of Classification Search
CPC ..... F02M 25/0818; F02M 25/0836; F02M 25/08; F02M 69/34; F02D 41/0045
See application file for complete search history.

(56) References Cited

U.S. PATENT DOCUMENTS 6,257,209 B1 7/2001 Hyodo et al.
7,565,900 B2 7/2009 Sato et al.
(Continued)

FOREIGN PATENT DOCUMENTS

JP H6-280636 A 10/1994
JP H6-280689 A 10/1994
(Continued)

OTHER PUBLICATIONS

International Search Report (ISR) for PCT/JP2018/014611 dated May 22, 2018 (3 pages including English translation).
(Continued)

*Primary Examiner* — Phutthiwat Wongwian
*Assistant Examiner* — Sherman D Manley
(74) *Attorney, Agent, or Firm* — Shumaker, Loop & Kendrick, LLP

(57) ABSTRACT

A detecting unit that detects a specific pressure difference between a pressure of gas that has passed throuch a canister and a pump and a pressure of the gas before passing through the canister and the pump. A gas flow rate from the pump may be higher with a smaller pressure difference between upstream and downstream sides relative to the pump, and higher with a higher purge gas density. A gas flow rate from the canister may be lower with a smaller pressure difference between upstream and downstream sides relative to the canister, and lower with a higher purge gas density. An estimating unit may estimate a flow rate of the purge gas while the specific pressure difference is an unchanged pressure difference being a pressure at which the flow rate of the gas is not chanced by the density of the purge gas.

5 Claims, 8 Drawing Sheets

(56) References Cited

U.S. PATENT DOCUMENTS

| | | | | |
|---|---|---|---|---|
| 9,556,828 | B2 * | 1/2017 | Weigl | F02M 25/089 |
| 9,771,900 | B2 * | 9/2017 | Makino | F02M 35/10222 |
| 10,415,411 | B2 | 9/2019 | Makino et al. | |
| 10,415,511 | B2 * | 9/2019 | Makino | F02D 13/0234 |
| 10,508,619 | B2 * | 12/2019 | Achleitner | F02M 25/0836 |
| 2007/0137622 | A1 * | 6/2007 | Koyama | F02M 25/089 123/520 |
| 2008/0179121 | A1 * | 7/2008 | Sauvlet | B60W 20/00 180/65.28 |
| 2018/0216578 | A1 * | 8/2018 | Wodausch | F02M 25/089 |
| 2020/0149485 | A1 * | 5/2020 | Asanuma | F02D 41/0045 |

FOREIGN PATENT DOCUMENTS

| | | | |
|---|---|---|---|
| JP | H8-177651 | A | 7/1996 |
| JP | H10-274108 | A | 10/1998 |
| JP | H11-264350 | A | 9/1999 |
| JP | 2007-146671 | A | 6/2007 |
| JP | 2007-198267 | A | 8/2007 |
| JP | 2007-231813 | A | 9/2007 |
| JP | 2012-117415 | A | 6/2012 |
| JP | 2016-217172 | A | 12/2016 |

OTHER PUBLICATIONS

Written Opinion for PCT/JP2018/014611 dated May 22, 2018 (7 pages including the English translation).

* cited by examiner

FIG. 7

102

700

| Load Factor / EN Rotational Speed | ··· | 20% | ··· | 40% | ··· |
|---|---|---|---|---|---|
| ··· | ··· | ··· | ··· | ··· | ··· |
| 2000rpm | ··· | Xrpm | ··· | Yrpm | ··· |
| ··· | ··· | ··· | ··· | ··· | ··· |

702

| Pressure Difference / P Rotational Speed | ··· | -2.5kPa | ··· | -4kPa | ··· |
|---|---|---|---|---|---|
| ··· | ··· | ··· | ··· | ··· | ··· |
| 30000rpm | ··· | M% | ··· | N% | ··· |
| ··· | ··· | ··· | ··· | ··· | ··· |

704

| P Rotational Speed / Duty Cycle | ··· | 30000rpm | ··· | 40000rpm | ··· |
|---|---|---|---|---|---|
| ··· | ··· | ··· | ··· | ··· | ··· |
| 50% | ··· | P L/min | ··· | Q L/min | ··· |
| ··· | ··· | ··· | ··· | ··· | ··· |

FIG. 10

102

700

| Load Factor / EN Rotational Speed | ··· | 20% | ··· | 40% | ··· |
|---|---|---|---|---|---|
| ··· | ··· | ··· | ··· | ··· | ··· |
| 2000rpm | ··· | Xrpm | ··· | Yrpm | ··· |
| ··· | ··· | ··· | ··· | ··· | ··· |

800

| Load Factor / EN Rotational Speed | ··· | 20% | ··· | 40% | ··· |
|---|---|---|---|---|---|
| ··· | ··· | ··· | ··· | ··· | ··· |
| 2000rpm | ··· | R% | ··· | S% | ··· |
| ··· | ··· | ··· | ··· | ··· | ··· |

802

| Duty Cycle / P Rotational Speed | ··· | 25% | ··· | 50% | ··· |
|---|---|---|---|---|---|
| ··· | ··· | ··· | ··· | ··· | ··· |
| 30000rpm | ··· | TkPa | ··· | UkPa | ··· |
| ··· | ··· | ··· | ··· | ··· | ··· |

EVAPORATED FUEL PROCESSING DEVICE

TECHNICAL FIELD

The disclosure herein relates to an evaporated fuel processing device mounted on a vehicle.

Background Art

Japanese Patent Application Publication No. H10-274108 describes an evaporated fuel processing device configured to supply purge gas containing evaporated fuel to an intake passage connected to an engine. The evaporated fuel processing device is provided with a purge passage connected between an upstream throttle valve and a downstream throttle valve that are disposed on the intake passage. In the evaporated fuel processing device, apertures of the upstream throttle valve and the downstream throttle valve are adjusted to adjust a negative pressure in the intake passage between the upstream throttle valve and the downstream throttle valve. Due to this, a flow rate of the purge gas supplied to the intake passage from the purge passage is adjusted.

SUMMARY

Technical Problem

As environment-friendly measures, a configuration for suppressing a rotational speed of an engine or a configuration of disposing a supercharger on an intake passage is employed, for example. In such cases, a negative pressure may not be generated in the intake passage to such an extent that purge gas can sufficiently be supplied to the intake passage, despite using an upstream throttle valve and a downstream throttle valve.

To address this, considerations are given to disposing a pump configured to pump out purge gas toward the intake passage. The disclosure herein provides art that estimates a flow rate of purge gas supplied to an intake passage in a case where the purge gas is pumped out by a pump.

Solution to Technical Problem

The art disclosed herein relates to an evaporated fuel processing device. The evaporated fuel processing device may comprise: a canister disposed between a fuel tank and an intake passage, and configured to store evaporated fuel generated in the fuel tank; a pump configured to pump purge gas toward the intake passage through a purge passage connecting the canister and the intake passage, the purge gas including the evaporated fuel stored in the canister; a detecting unit configured to detect a specific pressure difference between a pressure of gas that has passed through the canister and the pump and a pressure of the gas before passing through the canister and the pump; and an estimating unit configured to estimate a flow rate of the purge gas supplied to the intake passage using the specific pressure difference. A flow rate of the gas pumped out from the pump may be higher with a smaller pressure difference between upstream and downstream sides relative to the pump, the flow rate of the gas pumped out from the pump may be higher with a higher density of the purge gas, a flow rate of the gas supplied from the canister may be lower with a smaller pressure difference between upstream and downstream sides relative to the canister, the flow rate of the gas supplied from the canister may be lower with a higher density of the purge gas, and the estimating unit may estimate the flow rate of the purge gas while the specific pressure difference is an unchanged pressure difference, the unchanged pressure difference being a pressure at which the flow rate of the gas is not changed due to the density of the purge gas.

The density of the purge gas changes depending on a concentration of the evaporated fuel in the purge gas and temperatures. Due to this, in order to accurately estimate a flow rate of the purge gas using the aforementioned specific pressure difference, considerations must be given to characteristics of a flow rate of the purge gas with respect to the density of the purge gas upon when it passes through the pump and the canister.

In the above configuration, a characteristic of the flow rate of the purge gas with respect to the aforementioned specific pressure difference and a characteristic of the flow rate with respect to the density of the purge gas in the pump are respectively opposite to those in the canister. Due to this, there is the specific pressure difference at which the flow rate of the purge gas does not change due to the density of the purge gas passing through the canister and the pump. According to the above configuration, the flow rate of the purge gas is estimated during when the unchanged pressure difference at which the flow rate is not changed due to the density of the purge gas takes place. By doing so, an estimation error of the flow rate due to the density of the purge gas can be suppressed.

The evaporated fuel processing device may further comprise: an intake adjusting valve configured to adjust an air amount introduced to the intake passage not through the purge passage; and a controller configured to control the intake adjusting valve to cause the intake adjusting valve to adjust the air amount. The controller may cause the intake adjusting valve to adjust the air amount such that the specific pressure difference becomes the unchanged pressure difference, and the estimating unit may estimate the flow rate of the purge gas while the intake adjusting valve adjusts the air amount such that the specific pressure difference becomes the unchanged pressure difference. According to this configuration, the aforementioned specific pressure difference can be adjusted to the unchanged pressure difference by using the intake adjusting valve. Due to this, the aforementioned specific pressure difference can be adjusted to the unchanged pressure difference at a timing when the flow rate is to be estimated.

The evaporated fuel processing device may further comprise: a controller configured to control a rotational speed of the pump when the purge gas is supplied to the intake passage. The estimating unit may estimate the flow rate of the purge gas while the rotational speed is adjusted such that the specific pressure difference becomes the unchanged pressure difference. According to this configuration, the aforementioned specific pressure difference can be adjusted to the unchanged pressure difference by using the pump. Due to this, the aforementioned specific pressure difference can be adjusted to the unchanged pressure difference at a timing when the flow rate is to be estimated.

The evaporated fuel processing device may further comprise: a control valve disposed on the purge passage and configured to switch between a state of closing the purge passage and a state of opening the purge passage; and a controller configured to adjust an aperture of the control valve when the purge gas is supplied to the intake passage. A flow rate of gas passing through the control valve may be higher with a larger aperture, and the flow rate of gas passing through the control valve may be lower with a lower density, and the estimating unit may estimate the flow rate of the purge gas while the aperture is adjusted to an aperture with which the flow rate of the gas is not changed due to the density. According to this configuration, the aforementioned specific pressure difference can be adjusted to the unchanged pressure difference by using the control valve. Due to this, the aforementioned specific pressure difference can be adjusted to the unchanged pressure difference at a timing when the flow rate is to be estimated.

The estimating unit may calculate a concentration of the evaporated fuel included in the purge gas using an estimated flow rate of the purge gas. According to this configuration, the concentration of the evaporated fuel can be calculated by using the flow rate of the purge gas that has been suitably estimated.

BRIEF DESCRIPTION OF DRAWINGS

FIG. 7 shows data maps stored in a controller according to the first embodiment;

FIG. 10 shows data maps stored in a controller according to the second embodiment.

DETAILED DESCRIPTION

First Embodiment

Figure 1:
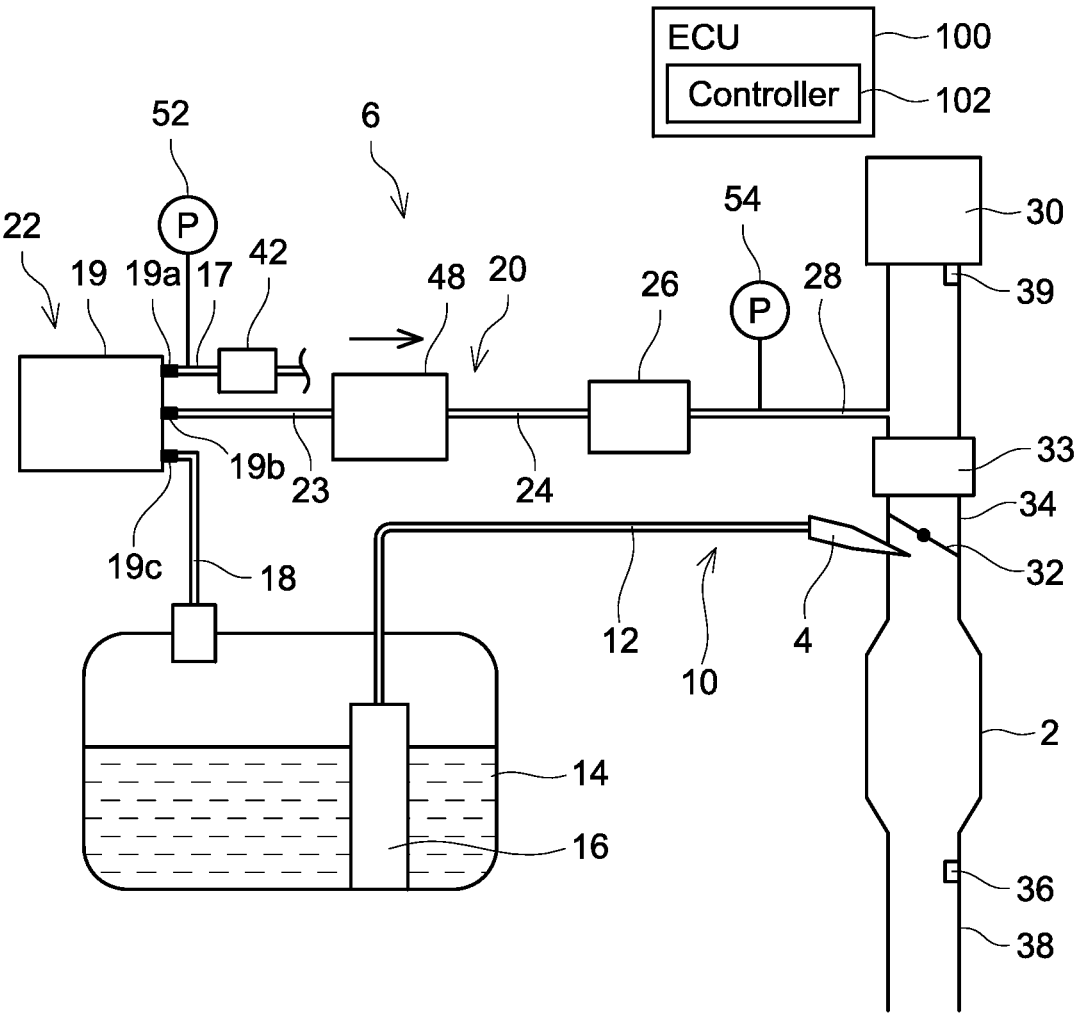
FIG. 1 shows an overview of a fuel supply system of an automobile, according to a first embodiment.

A fuel supply system 6 provided with an evaporated fuel processing device 20 will be described with reference to FIG. 1. The fuel supply system 6 is mounted on a vehicle such as an automobile and so on, and provided with a main supply passage 10 for supplying fuel stored in a fuel tank 14 to an engine 2 and an evaporated fuel passage 22 for supplying evaporated fuel generated in the fuel tank 14 to the engine 2.

The main supply passage 10 is provided with a fuel pump unit 16, a supply passage 12, and an injector 4. The fuel pump unit 16 is provided with a fuel pump, a pressure regulator, a control circuit, and the like. The fuel pump unit 16 controls the fuel pump according to a signal supplied from an ECU 100. The fuel pump boosts a pressure of the fuel in the fuel tank 14 and discharges the same. The pressure of the fuel discharged from the fuel pump is regulated by the pressure regulator, and the fuel is supplied from the fuel pump unit 16 to the supply passage 12. The supply passage 12 is connected to the fuel pump unit 16 and the injector 4. The fuel supplied to the supply passage 12 passes through the supply passage 12 and reaches the injector 4. The injector 4 includes a valve (not shown) of which aperture is controlled by the ECU 100. When the valve of the injector 4 is opened, the fuel in the supply passage 12 is supplied to an intake passage 34 connected to the engine 2.

The intake passage 34 is connected to an air cleaner 30. The air cleaner 30 is provided with a filter for removing foreign particles from air flowing into the intake passage 34. A throttle valve 32 is provided in the intake passage 34 between the engine 2 and the air cleaner 30. When the throttle valve 32 opens, air suction is performed from the air cleaner 30 toward the engine 2. The throttle valve 32 is a butterfly valve. The ECU 100 adjusts an aperture of the throttle valve 32 to change an opening area of the intake passage 34 to adjust an air amount flowing into the engine 2. The throttle valve 32 is provided on an air cleaner 30 side relative to the injector 4.

A supercharger 33 is provided between the throttle valve 32 and the air cleaner 30. The supercharger 33 is a so-called turbocharger in which a turbine is rotated by exhaust gas from the engine 2 to introduce air to the engine 2.

An air flowmeter 39 is provided on the intake passage 34 between the air cleaner 30 and the supercharger 33. The air flowmeter 39 is of one of a hot-wire type, a Karman's vortex type, and a movable-plate type. The air flowmeter 39 is configured to detect an air amount introduced to the intake passage 34 from open air through the air cleaner 30.

Gas which has been combusted in the engine 2 passes through an exhaust passage 38 and is discharged therefrom. An air-fuel ratio sensor 36 is provided on the exhaust passage 38. The air-fuel ratio sensor 36 is configured to detect an air-fuel ratio in the exhaust passage 38. When acquiring the air-fuel ratio from the air-fuel ratio sensor 36, the ECU 100 estimates an air-fuel ratio of gas supplied to the engine 2.

The evaporated fuel passage 22 is arranged side by side with the main supply passage 10. The evaporated fuel passage 22 is a passage through which evaporated fuel generated in the fuel tank 14 passes when moving from the fuel tank 14 to the intake passage 34 via a canister 19. As will be described later, the evaporated fuel is mixed with air in the canister 19. The mixed gas of the evaporated fuel and the air, which is mixed in the canister 19, is termed purge gas. The evaporated fuel passage 22 is provided with the evaporated fuel processing device 20. The evaporated fuel processing device 20 is provided with the canister 19, a control valve 26, a pump 48, a controller 102 in the ECU 100, and pressure sensors 52, 54.

The fuel tank 14 and the canister 19 are connected to each other by a tank passage 18. The canister 19 is arranged at one end of a purge passage 23 and is connected to the pump 48 via the purge passage 23. The pump 48 is connected to the control valve 26 via a purge passage 24. The control valve 26 is connected to the intake passage 34 via a purge passage 28. The purge passages 23, 24 are connected to the intake passage 34 between the air flowmeter 39 and the supercharger 33 via the control valve 26 and the purge passage 28. Due to this, the canister 19 and the intake passage 34 are connected via the purge passages 23, 24, 28.

The control valve 26 is arranged between the purge passage 28 and the purge passage 24. The control valve 26 is a solenoid valve controlled by the controller 102 and is controlled by the controller 102 to switch between an open state of being opened and a closed state of being closed. In the closed state, the control valve 26 closes the purge passage 24 and cuts off communication between the purge passage 28 and the purge passage 24. In the open state, the control valve 26 opens the purge passage 24 and communicates the purge passage 28 and the purge passage 24. The controller 102 is configured to execute duty control of continuously switching the open state and the closed state of the control valve 26 according to a duty cycle determined by the air-fuel ratio and the like. The duty cycle represents a ratio of a duration of one open state relative to a total duration of one closed state and one open state which take place successively while the control valve 26 is continuously switching between the closed state and the open state during the duty control. The control valve 26 adjusts a flow rate of the purge gas to be supplied to the intake passage 34 by adjusting the duty cycle (that is, a duration of the open state).

The pump 48 is arranged between the purge passage 24 and the purge passage 23. The pump 48 is a so-called vortex pump (which may be also called cascade pump or Wesco pump) or a turbomolecular pump (axial flow pump, mixed flow pump, centrifugal pump). The pump 48 is controlled by the controller 102. When the pump 48 is driven, the purge gas is suctioned from the canister 19 into the pump 48 through the purge passage 23. A pressure of the purge gas suctioned to the pump 48 is boosted in the pump 48 and the purge gas is then pumped out to the purge passage 24. The purge gas pumped to the purge passage 24 flows through the purge passage 24, the control valve 26, and the purge passage 28 and then is supplied to the intake passage 34.

The canister 19 is connected to the pump 48 via the purge passage 23. The canister 19 is provided with an open air port 19*a*, a purge port 19*b*, and a tank port 19*c*. The open air port 19*a* communicates with open air through an open air passage 17 and an air filter 42. After air has flowed through the air filter 42, the air may flow into the canister 19 from the open air port 19*a* through the open air passage 17. When this happens, the air filter 42 suppresses foreign particles in the air from entering the canister 19.

The purge port 19*b* is connected to the purge passage 23. The tank port 19*c* is connected to the fuel tank 14 via the tank passage 18.

Activated carbon (not shown) is accommodated in the canister 19. The activated carbon adsorbs the evaporated fuel from gas flowing into the canister 19 from the fuel tank 14 through the tank passage 18 and the tank port 19*c*. Gas from which the evaporated fuel has been adsorbed is discharged to open air through the open air port 19*a* and the open air passage 17. The canister 19 can suppress the evaporated fuel in the fuel tank 14 from being discharged to open air. The evaporated fuel adsorbed by the activated carbon is supplied to the purge passage 23 from the purge port 19*b*.

The pressure sensor 52 configured to detect a pressure of the open air passage 17 is disposed on the open air passage 17. Further, the pressure sensor 54 configured to detect a pressure of the purge passage 28 is disposed on the purge passage 28. The pressure of the open air passage 17 is substantially equal to an atmospheric pressure. In a variant, the pressure sensor 52 may be disposed at a position for detecting the atmospheric pressure. Further, the pressure sensor 54 may be disposed on an upstream side relative to the supercharger 33 of the intake passage 34.

The controller 102 is connected to the pump 48, the control valve 26, and the pressure sensors 52, 54. The controller 102 includes a CPU and a memory such as a ROM, a RAM and the like. The controller 102 is configured to control the pump 48 and the control valve 26. Further, the controller 102 is configured to acquire the pressures detected by the pressure sensors 52, 54. Lines connecting the ECU 100 and the respective units are omitted. The controller 102 stores a computer program for causing the controller 102 to execute a concentration calculation process to be described later. Data maps stored in advance in the controller 102 will be described later.

Next, an operation of the evaporated fuel processing device 20 will be described. When a purge condition is satisfied while the engine 2 is driven, the controller 102 executes a purge process of supplying the purge gas to the engine 2 by executing the duty control on the control valve 26. When the purge process is executed, the purge gas is supplied in a direction from left to right as indicated by an arrow in FIG. 1. The purge condition is a condition that is satisfied when the purge process of supplying the purge gas to the engine 2 is to be executed, and is a condition that is preset in the controller 102 by a manufacturer according to a cooling water temperature for the engine 2 and a concentration of the evaporated fuel in the purge gas (which is hereinbelow termed "purge concentration"). The controller 102 monitors whether or not the purge condition is satisfied at all times while the engine 2 is driven. The controller 102 controls the duty cycle of the control valve 26 based on the purge concentration and a measured value of the air flowmeter 39. By doing so, the purge gas that was adsorbed in the canister 19 is introduced to the engine 2.

When executing the purge process, the controller 102 drives the pump 48 to supply the purge gas to the intake passage 34. As a result, the purge gas can be supplied even in a case where a negative pressure in the intake passage 34 is small.

The ECU 100 is configured to control the throttle valve 32. Further, the ECU 100 is also configured to control a fuel injection amount by the injector 4. Specifically, it controls the fuel injection amount by controlling an open time of the valve of the injector 4. When the engine 2 is driven, the ECU 100 calculates a fuel injection time (that is, the open time of the valve of the injector 4), during which injection is performed from the injector 4 to the engine 2, per unit time. The fuel injection time is determined by correcting a reference injection time predetermined by experiments to maintain an air-fuel ratio at a target air-fuel ratio (such as an ideal air-fuel ratio). Further, the ECU 100 is configured to correct the fuel injection amount based on the flow rate of the purge gas and the purge concentration.

(Flow Rate Characteristics of the Purge Gas in Pump, Canister, and Control Valve)

Figure 2:
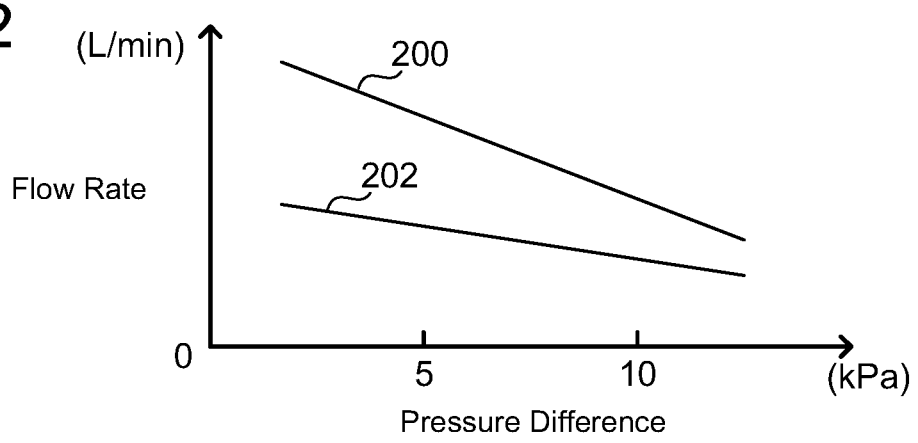
FIG. 2 shows a graph illustrating relationships between a pressure difference and a flow rate of purge gas in a pump, according to the first embodiment.

Next, flow rate characteristics of the purge gas in each of the pump 48, the canister 19, and the control valve 26 will be described. FIG. 2 shows relationships between the flow rate of the purge gas pumped out from the pump 48 and pressure difference between a pressure on an upstream side relative to the pump 48 and a pressure on a downstream side relative thereto (that is, a value obtained by subtracting the pressure on the upstream side from the pressure on the downstream side). A horizontal axis of FIG. 2 shows the pressure difference. A vertical axis of FIG. 2 shows the flow rate, and the flow rate becomes higher toward an upper side thereof. A characteristic 200 shows a relationship between the pressure difference and the flow rate in a case where the purge concentration is 100% (that is, in a case where the purge gas contains only the evaporated fuel), and a characteristic 202 shows a relationship between the pressure difference and the flow rate in a case where the purge concentration is 0% (that is, in a case where the purge gas does not contain any evaporated fuel). The purge concentration can be also termed a density of the purge gas.

In the pump 48, the flow rate of the purge gas is higher with a smaller pressure difference, regardless of the purge concentration. On the other hand, the flow rate of the purge gas is higher with a higher purge concentration, regardless of the pressure difference.

Figure 3:
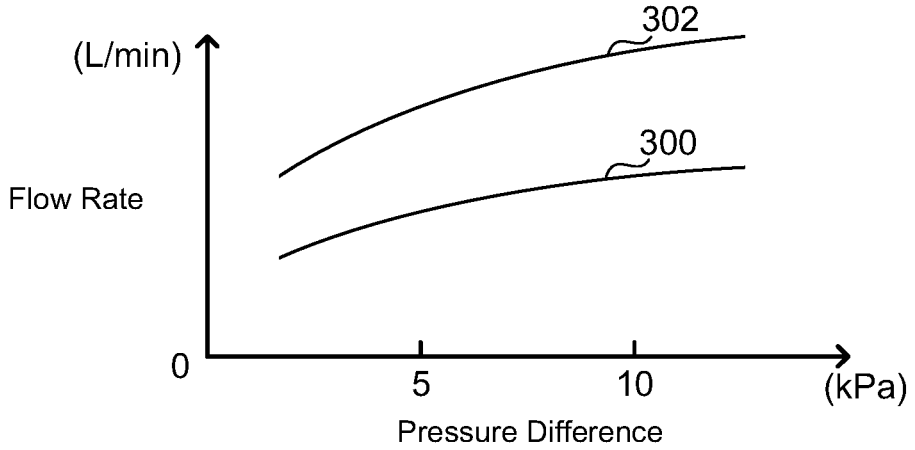
FIG. 3 shows a graph illustrating relationships between a pressure difference and a flow rate of the purge gas in a canister, according to the first embodiment.

FIG. 3 shows relationships between the flow rate of the purge gas supplied from the canister 19 and pressure difference between a pressure on an upstream side relative to the canister 19 and a pressure on a downstream side relative thereto (that is, a value obtained by subtracting the pressure on the upstream side from the pressure on the downstream side). A horizontal axis and a vertical axis of FIG. 3 are the same as the horizontal axis and the vertical axis of FIG. 2, respectively. A characteristic 300 shows a relationship between the pressure difference and the flow rate in the case where the purge concentration is 100%, and a characteristic 302 shows a relationship between the pressure difference and the flow rate in the case where the purge concentration is 0%. In the canister 19, the flow rate of the purge gas is lower with a smaller pressure difference, regardless of the purge concentration. On the other hand, the flow rate of the purge gas is lower with a higher purge concentration, regardless of the pressure difference.

Figure 4:
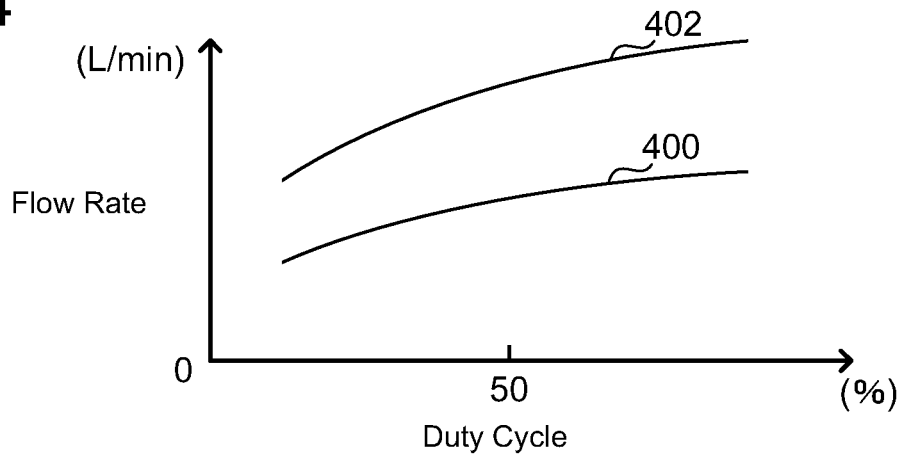
FIG. 4 shows a graph illustrating relationships between an aperture and a flow rate of the purge gas in a control valve, according to the first embodiment.

FIG. 4 shows relationships between the duty cycle of the control valve 26 and the flow rate of the purge gas supplied from the control valve 26. A horizontal axis of FIG. 4 shows the duty cycle, and the duty cycle becomes higher toward a right side thereof. A vertical axis of FIG. 4 is the same as the vertical axis of FIG. 2. A characteristic 400 shows a relationship between the duty cycle and the flow rate in the case where the purge concentration is 100%, and a characteristic 402 shows a relationship between the duty cycle and the flow rate in the case where the purge concentration is 0%. In the control valve 26, the flow rate of the purge gas is higher with a larger duty cycle (that is, aperture), regardless of the purge concentration. On the other hand, the flow rate of the purge gas is lower with a higher purge concentration, regardless of the duty cycle.

Figure 5:
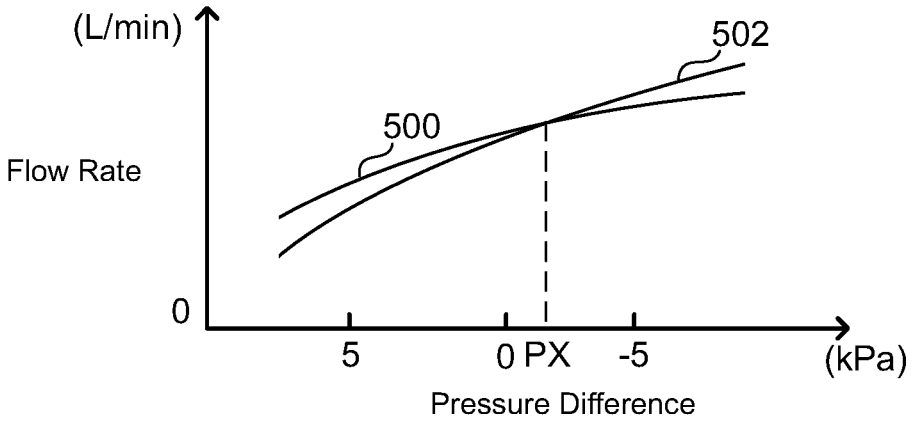
FIG. 5 shows a graph illustrating relationships between pressure difference and the flow rate of the purge gas in the pump, the canister and the control valve, according to the first embodiment.

FIG. 5 shows relationships between the flow rate of the purge gas supplied to the intake passage 34 from the canister 19 through the pump 48 and the control valve 26 and a pressure difference (PL−PU) that is obtained by subtracting the pressure of the open air passage 17 on the upstream side relative to the canister 19, that is, a pressure PU detected by the pressure sensor 52, from the pressure of the purge passage 28 on the downstream side relative to the control valve 26, that is, a pressure PL detected by the pressure sensor 54 (this pressure difference is an example of "a specific pressure difference").

A horizontal axis of FIG. 5 shows the pressure difference (PL−PU), and the pressure PU becomes larger than the pressure PL toward the right side thereof. A vertical axis of FIG. 5 is the same as the vertical axis of FIG. 2. A characteristic 500 shows a relationship between the pressure difference and the flow rate in the case where the purge concentration is 100%, and a characteristic 502 shows a relationship between the pressure difference and the flow rate in the case where the purge concentration is 0%.

The characteristic 500 and the characteristic 502 intersect each other at a pressure difference (PL−PU)=PX. That is, when the pressure difference is the pressure difference PX, the flow rate of the purge gas is not changed due to the purge concentration (that is, the density of the purge gas). The controller 102 calculates the purge concentration when the pressure difference is the pressure difference PX. Hereinbelow, the pressure difference PX is termed an "unchanged pressure difference PX".

(Concentration Calculation Process)

Next, a process of calculating the purge concentration will be described. The controller 102 calculates the purge concentration by using the air-fuel ratio and the flow rate of the purge gas. The purge concentration is calculated under a situation in which a gas amount introduced to the engine 2 through the intake passage 34, that is, a total of an air amount introduced to the intake passage 34 through the air cleaner 30 and the purge gas introduced to the intake passage 34 from the purge passage 28, is stable.

Figure 6:
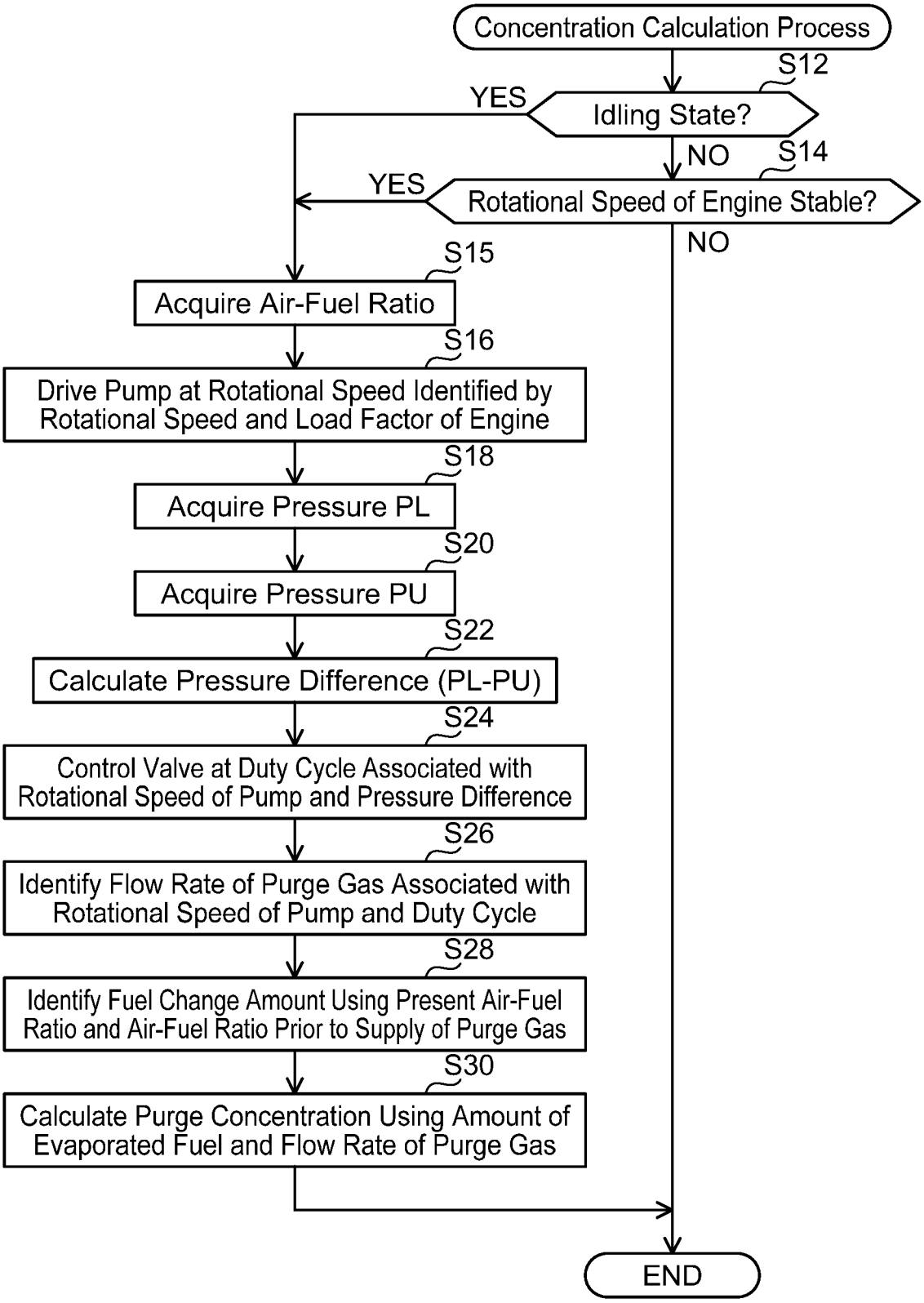
FIG. 6 shows a flowchart of a concentration calculation process according to the first embodiment.

The concentration calculation process is started when an ignition switch of the vehicle is switched from off to on, and is repeatedly executed while the ignition switch is on. As shown in FIG. 6, in the concentration calculation process, firstly in S12 the controller 102 determines whether or not the vehicle is in an idling state. The idling state is a state in which the vehicle is not traveling but the engine 2 is being driven. In the idling state, the engine 2 is driven at a predetermined rotational speed and the gas amount introduced to the engine 2 is stable. The controller 102 determines that the vehicle is in the idling state in a case where a vehicle speed is 0 km/hr and the rotational speed of the engine 2 is stable at the predetermined rotational speed, while it determines that the vehicle is not in the idling state in a case where the vehicle speed is greater than 0 km/hr or in a case where the rotational speed of the engine 2 is not stable at the predetermined rotational speed.

In a case of determining that the vehicle is not in the idling state (NO in S12), the controller 102 determines in S14 whether or not the rotational speed of the engine 2 is stable. For example, if the vehicle is traveling on a flat road at a constant speed, the rotational speed of the engine 2 is stable. In a case where the rotational speed of the engine 2 is not stable (S14), the concentration calculation process is terminated. In the case where the rotational speed of the engine 2 is not stable, the gas amount introduced to the engine 2 is not stable. In this case, the concentration calculation process is terminated without calculating the purge concentration. According to this configuration, calculation of the purge concentration can be suppressed in a situation in which it is difficult for the gas amount introduced to the engine 2, that is, the flow rate of the purge gas, to be stable. Due to this, an error in calculation of the purge concentration can be suppressed.

On the other hand, in the case of determining that the vehicle is in the idling state (YES in S12) or in a case where the rotational speed of the engine 2 is stable (YES in S14), which is in other words, in a case where the gas amount introduced to the engine 2 is stable, the process is preceded to S15. In S15, the controller 102 acquires an air-fuel ratio while the purge gas is not supplied to the engine 2. In a case where the purge process is in execution when S15 is executed, the controller 102 stops the purge process and then acquires the air-fuel ratio while the purge gas is not supplied to the engine 2. On the other hand, in a case where the purge process is not in execution when S15 is executed, the controller 102 acquires the air-fuel ratio of the present when the purge gas is not supplied to the engine 2. When the process of S15 is completed, the process is preceded to S16.

In S16, the controller 102 drives the pump 48 at a rotational speed that is identified by using the rotational speed of the engine 2 and a load factor of the engine 2. Specifically, firstly the controller 102 acquires the rotational speed of the engine 2 and the load factor of the engine 2 from the ECU 100. Then, as shown in FIG. 7, the controller 102 uses a data map 700 stored therein in advance to identify a rotational speed recorded in association with the acquired rotational speed and load factor of the engine 2. Although alphabetical letters such as "X" and the like are used in data maps 700, 702, 704, 800, 802 in FIG. 7 and in FIG. 10 to be described later, numerical values are recorded in actuality instead of the letters. Further, " " in the data maps 700, 702, 704, 800, 802 indicate that numerical values are omitted.

The data map 700 is identified in advance by experiments or simulation, and is stored in the controller 102. The gas amount to be introduced to the engine 2 varies according to the rotational speed and load factor of the engine 2. Due to this, when the rotational speed and load factor of the engine 2 change, the pressure in the intake passage 34, that is, the pressure PL detected by the pressure sensor 54, changes despite no change in the rotational speed of the pump 48. The pressure PL can be controlled by changing the rotational speed of the pump 48 according to the rotational speed and load factor of the engine 2. The data map 700 records rotational speeds of the pump 48 at which the pressure PL does not vary drastically according to the rotational speed and load factor of the engine 2.

When the rotational speed is identified, the controller 102 drives the pump 48 at the identified rotational speed. Then, in S18 of FIG. 6, the controller 102 acquires the pressure PL detected by the pressure sensor 54. Then, in S20, the controller 102 acquires the pressure PU detected by the pressure sensor 52. In subsequent S22, the controller 102 calculates the pressure difference (PL−PU).

Then, in S24, the controller 102 executes the duty control on the control valve 26 at a duty cycle identified by using the rotational speed of the pump 48 identified in S16 and the pressure difference (PL−PU) calculated in S22. Specifically, as shown in FIG. 7, the controller 102 uses the data map 702 stored therein in advance to identify a duty cycle recorded in association with the identified rotational speed of the pump 48 and the calculated pressure difference (PL−PU).

The data map 702 is identified in advance by experiments or simulation and is stored in the controller 102. The data map 702 records therein a combination of the rotational speed of the pump 48 and the duty cycle, with which the pressure difference (PL−PU) calculated in S22, that is, the present pressure difference (PL−PU), becomes the unchanged pressure difference PX.

When the duty cycle is identified, the controller 102 executes the duty control on the control valve 26 at the identified duty cycle. Due to this, the rotational speed of the pump 48 and the duty cycle of the control valve 26 are adjusted to achieve the unchanged pressure difference PX.

Next, in S26 of FIG. 6, the controller 102 identifies a flow rate of the purge gas by using the rotational speed of the pump 48 identified in S16 and the duty cycle identified in S24. Specifically, the controller 102 uses the data map 704 stored therein in advance to identify a flow rate of the purge gas recorded in association with the identified rotational speed of the pump 48 and the identified duty cycle, as shown in FIG. 7.

The data map 704 is identified in advance by experiments or simulation and is stored in the controller 102. In the experiments or the simulation, flow rates of the purge gas are measured with various rotational speeds of the pump 48 and duty cycles that achieve the unchanged pressure difference PX. Then, each of the measured flow rates of the purge gas is recorded in association with the rotational speed of the pump 48 and the duty cycle with which the flow rate of the purge gas was measured, by which the data map 704 is created.

According to this configuration, the flow rate of the purge gas while the rotational speed of the pump 48 and the duty cycle of the control valve 26 are adjusted to achieve the unchanged pressure difference PX can be identified. Due to this, an estimation error of the flow rate caused by the density of the purge gas can be suppressed. Further, by changing the rotational speed of the pump 48 and the duty cycle, the unchanged pressure difference PX can be achieved when the purge concentration is to be detected.

When the flow rate of the purge gas is identified, the controller 102 identifies in S28 a change amount of the fuel introduced to the engine 2 by using the present air-fuel ratio and the air-fuel ratio acquired in S15. Due to this, an amount of the evaporated fuel in the purge gas can be identified. Next, in S30, the controller 102 calculates a purge concentration by using the amount of the evaporated fuel identified in S28 and the flow rate of the purge gas identified in S26, and then terminates the concentration calculation process.

According to this configuration, the flow rate of the purge gas can be identified while suppressing an error in identifying the flow rate of the purge gas caused by the concentration of the purge gas. Due to this, the purge concentration can more accurately be calculated.

Second Embodiment

Figure 8:
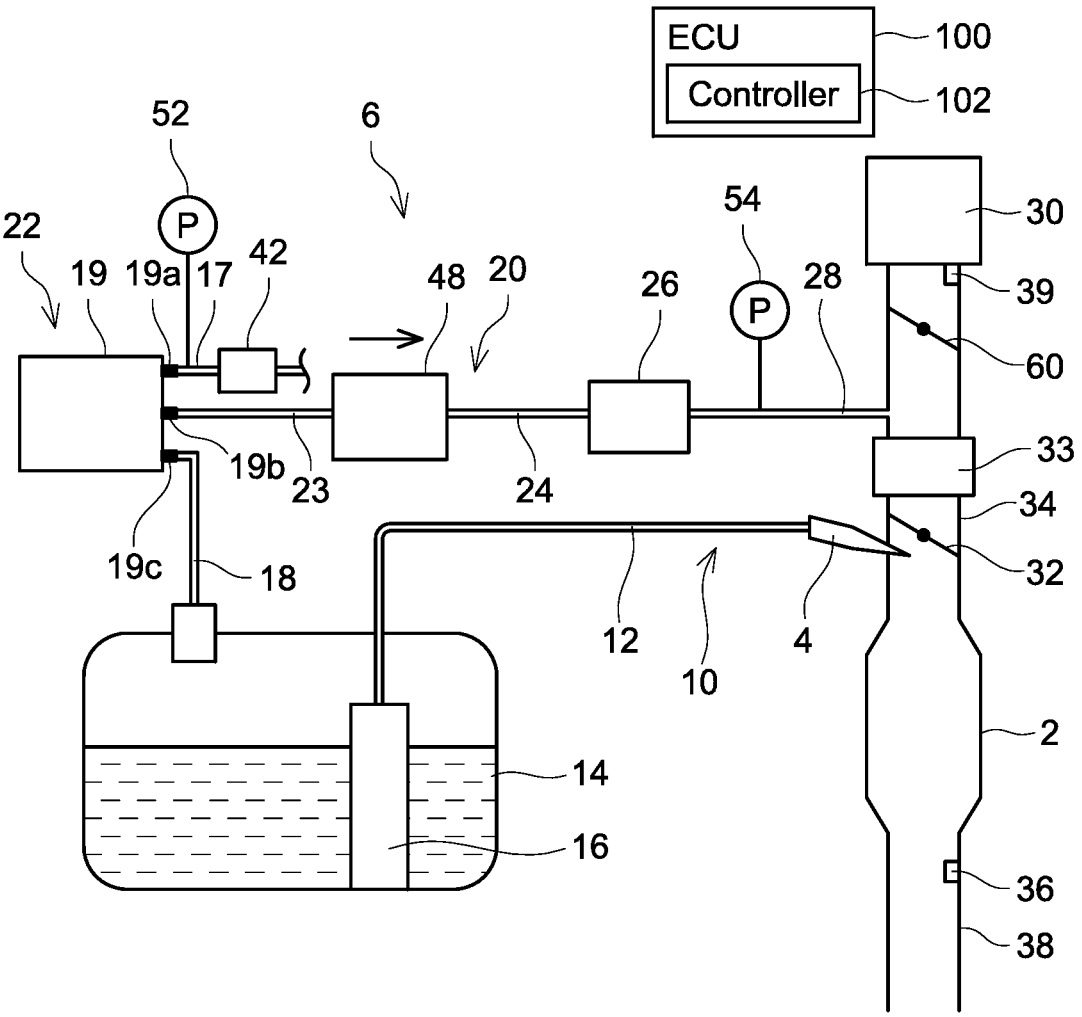
FIG. 8 shows an overview of a fuel supply system of an automobile, according to a second embodiment.

Features that differ from those of the first embodiment will be described. As shown in FIG. 8, the evaporated fuel processing device 20 of the present embodiment is provided with an intake throttle valve 60 which is disposed on the upstream side relative to the supercharger 33 and on the downstream side relative to the air cleaner 30, in addition to the elements of the first embodiment. The intake throttle valve 60 is disposed on the intake passage 34 on the upstream side relative to a position where the purge passage 28 is connected to the intake passage 34. The intake throttle valve 60 is a butterfly valve similar to the throttle valve 32. A valve type of the intake throttle valve 60 is not limited. The ECU 100 adjusts an aperture of the intake throttle valve 60 to change the opening area of the intake passage 34. By doing so, a negative pressure in the intake passage 34 between the supercharger 33 and the intake throttle valve 60 can be adjusted. As a result, the purge gas in the purge passage 28 can smoothly be supplied to the intake passage 34.

(Concentration Calculation Process)

Next, a concentration calculation process of the present embodiment will be described with reference to FIG. 9. In the concentration calculation process, firstly, processes of S12 to S16 are executed, similarly to the concentration calculation process of the first embodiment. When the pump 48 is driven at the identified rotational speed in S16, the controller 102 executes the duty control on the control valve 26 in S42 at a duty cycle identified by using the rotational speed of the engine 2 and the load factor of the engine 2. Specifically, as shown in FIG. 10, the controller 102 uses the data map 800 stored in advance in the controller 102 to identify a duty cycle recorded in association with the acquired rotational speed and load factor of the engine 2. The controller 102 of the present embodiment has the data map 700 stored in advance therein, similarly to the first embodiment.

The data map 800 is identified in advance by experiments or simulation and is stored in the controller 102. The pressure in the intake passage 34, that is, the pressure PL detected by the pressure sensor 54, changes according to the rotational speed and load factor of the engine 2. Due to this, the flow rate of the purge gas supplied from the purge passage 28 to the intake passage 34 changes, despite no change in the duty cycle. By changing the duty cycle according to the rotational speed and load factor of the engine 2, the duty cycle can be adjusted to a duty cycle at which the flow rate of the purge gas is not changed due to the concentration of the purge gas.

When the duty cycle is identified, the controller 102 executes the duty control on the control valve 26 at the identified duty cycle. Then, in S44 of FIG. 9, the controller 102 identifies an unchanged pressure difference PX by using the rotational speed of the pump 48 identified in S16 and the duty cycle identified in S42. Specifically, the controller 102 uses the data map 802 stored therein in advance to identify an unchanged pressure difference PX recorded in association with the identified rotational speed of the pump 48 and duty cycle of the control valve 26, as shown in FIG. 10.

The data map 802 is identified in advance by experiments or simulation and is stored in the controller 102. In the experiments or the simulation, the rotational speed of the pump 48, the duty cycle, and the purge concentration are changed variously, by which unchanged pressure differences PX at which the flow rate of the purge gas is not changed due to the purge concentration are identified.

Figure 9:
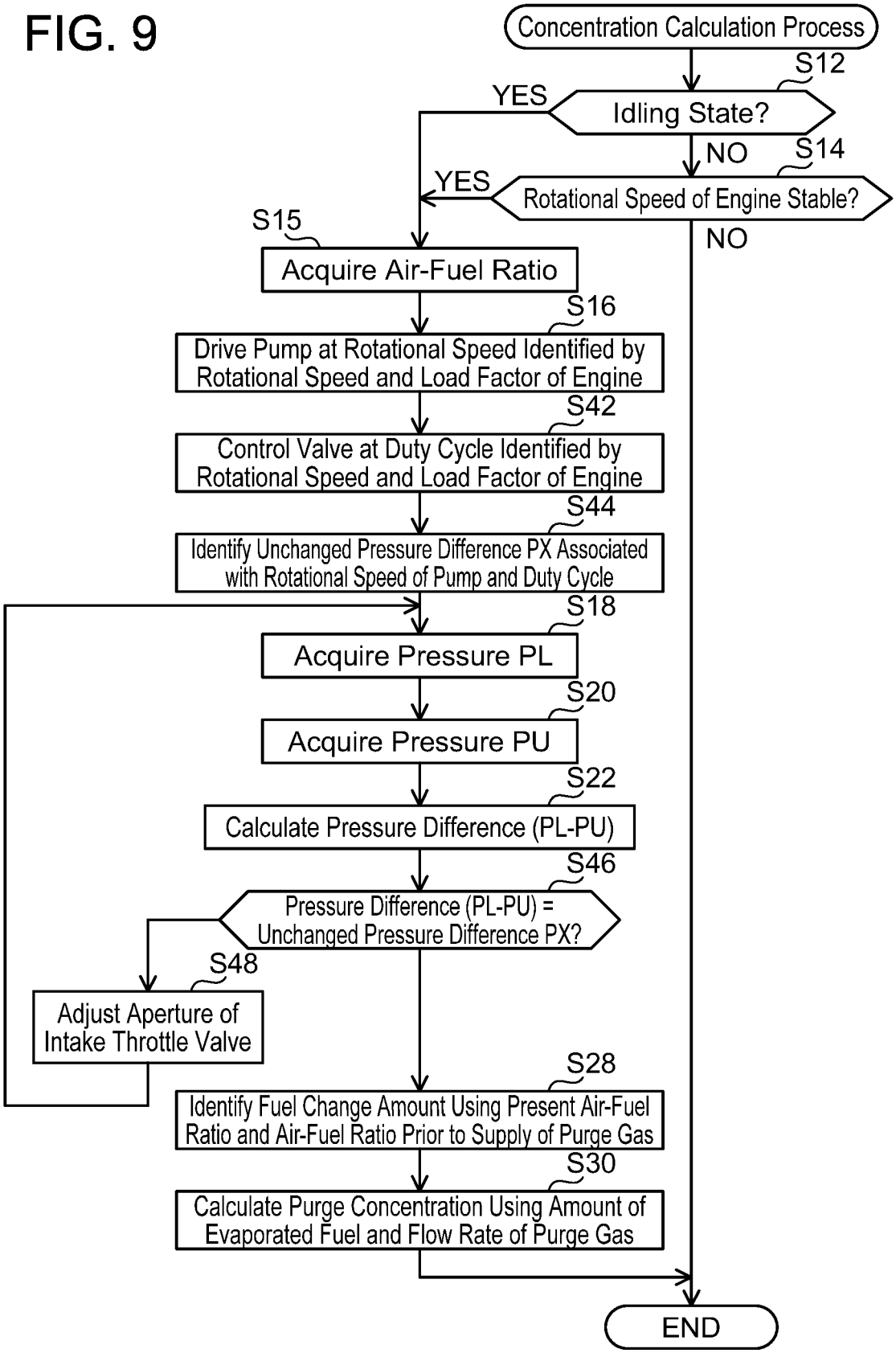
FIG. 9 shows a flowchart of a concentration calculation process according to the second embodiment.

Next, as shown in FIG. 9, processes of S18 to S22 are executed, similarly to the concentration calculation process of the first embodiment. Due to this, a pressure difference (PL−PU) is calculated.

Next, in S46, the controller 102 determines whether or not the pressure difference (PL−PU) calculated in S22 matches the unchanged pressure difference PX identified in S44. In a case where the pressure difference (PL−PU) does not match the identified unchanged pressure difference PX (NO in S46), the controller 102 adjusts the aperture of the intake throttle valve 60 in S48. Specifically, the controller 102 increases the aperture of the intake throttle valve 60 in a case where the pressure difference (PL−PU) is smaller than the identified unchanged pressure difference PX. By doing so, the pressure in the intake passage 34, that is, the pressure PL increases. On the other hand, the controller 102 decreases the aperture of the intake throttle valve 60 in a case where the pressure difference (PL−PU) is larger than the identified unchanged pressure difference PX. By doing so, the pressure in the intake passage 34, that is, the pressure PL decreases. When the process of S48 is completed, the controller 102 returns to S18.

On the other hand, in a case where the pressure difference (PL−PU) matches the identified unchanged pressure difference PX (YES in S46), the controller 102 executes processes of S28 and S30 similarly to the concentration calculation process of the first embodiment and then terminates the concentration calculation process.

According to this configuration, the pressure difference (PL−PU) can be adjusted to the unchanged pressure difference PX by using the intake throttle valve 60. Due to this, the pressure difference (PL−PU) can be adjusted to the unchanged pressure difference PX at a timing when the flow rate of the purge gas is to be estimated.

While specific examples of the present disclosure have been described above in detail, these examples are merely illustrative and place no limitation on the scope of the patent claims. The technology described in the patent claims also encompasses various changes and modifications to the specific examples described above.

(1) In the first embodiment as above, the rotational speed of the pump 48 and the duty cycle of the control valve 26 are adjusted in the concentration calculation process. However, only one of the rotational speed of the pump 48 and the duty cycle of the control valve 26 may be adjusted. For example, the controller 102 may execute the duty control with the duty cycle of the control valve 26 set at a predetermined duty cycle (such as 100%) in the concentration calculation process. In this case, the rotational speed of the pump 48 may be adjusted such that the pressure difference (PU-PL) becomes the unchanged pressure difference PX, and the flow rate of the purge gas may be estimated using the unchanged pressure difference PX while the pump 48 is driven at the adjusted rotational speed.

Alternatively, for example, the controller 102 may drive the pump 48 at a predetermined rotational speed (such as 30,000 rpm) in the concentration calculation process. In this case, the duty cycle of the control valve 26 may be adjusted such that the pressure difference (PU-PL) becomes the unchanged pressure difference PX, and the flow rate of the purge gas may be estimated using the unchanged pressure difference PX while the control valve 26 is controlled at the adjusted duty cycle.

(2) In the second embodiment as above, the rotational speed of the pump 48, the duty cycle of the control valve 26, and the aperture of the intake throttle valve 60 are adjusted in the concentration calculation process. However, only one or two of the rotational speed of the pump 48, the duty cycle of the control valve 26, and the aperture of the intake throttle valve 60 may be adjusted. For example, the controller 102 may drive the pump 48 at a predetermined rotational speed and execute the duty control on the control valve 26 at a predetermined duty cycle (such as 100%) in the concentration calculation process. In this case, the aperture of the intake throttle valve 60 may be adjusted such that the pressure difference (PU-PL) becomes the unchanged pressure difference PX, and the flow rate of the purge gas may be estimated using the unchanged pressure difference PX while the intake throttle valve 60 is opened at the adjusted aperture.

Alternatively, for example, the controller 102 may drive the pump 48 at a predetermined rotational speed or execute the duty control on the control valve 26 at a predetermined duty cycle (such as 100%) in the concentration calculation process. In this case, the aperture of the intake throttle valve 60 and the rotational speed of the pump 48 or the duty cycle of the control valve 26 may be adjusted such that the pressure difference (PU-PL) becomes the unchanged pressure difference PX, and the flow rate of the purge gas may be estimated using the unchanged pressure difference PX while the aforementioned adjusted state is maintained.

(3) In the embodiments as above, the evaporated fuel processing device 20 is provided with the control valve 26. However, the evaporated fuel processing device 20 may not be provided with the control valve 26. In this case, at least one of the rotational speed of the pump 48 and the aperture of the intake throttle valve 60 (only in the second embodiment) may be adjusted such that the pressure difference (PU-PL) becomes the unchanged pressure difference PX.

(4) In the embodiments as above, the aperture is determined for the control valve 26 according to the duty cycle. However, the control valve 26 may be a valve of which aperture is adjustable by controlling a position of a valve body, for example. In this case, the aperture of the control valve 26 may be adjusted such that the pressure difference (PU-PL) becomes the unchanged pressure difference PX.

(5) The controller 102 may be provided separately from the ECU 100.

(6) The supercharger 33 may not be provided on the intake passage 34.

(7) In the embodiments, the pump 48 is disposed between the purge passage 23 and the purge passage 24. However, a position of the pump 48 is not limited thereto, and it may be disposed on the open air passage 17, for example.

(8) In the embodiments as above, the rotational speed of the pump 48 and/or the like is adjusted such that the pressure difference (PU-PL) becomes the unchanged pressure difference PX. However, the controller 102 may acquire the rotational speed of the pump 48, the duty cycle of the control valve 26, and the pressure difference (PU-PL) while the purge process is in execution, and may estimate the flow rate of the purge gas at a timing when the pressure difference (PU-PL) becomes the unchanged pressure difference PX.

(9) In the embodiments as above, the purge passage 28 is connected to the intake passage 34 between the air flowmeter 39 and the supercharger 33. However, the purge passage 28 may be connected to the intake passage 34 between the throttle valve 32 and the engine 2.

(10) The pressure PU as above is detected by the pressure sensor 52. However, the atmospheric pressure may be used as the pressure PU. The atmospheric pressure may be acquired from an atmospheric pressure sensor mounted on the vehicle. Further, a pressure estimated from the flow rate in the air flowmeter 39 may be used as the pressure PL.

The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. An evaporated fuel processing device comprising:

a canister disposed between a fuel tank and an intake passage, and configured to store evaporated fuel generated in the fuel tank;

a pump configured to pump purge gas toward the intake passage through a purge passage connecting the canister and the intake passage, the purge gas including the evaporated fuel stored in the canister;

a detecting unit configured to detect a specific pressure difference between a pressure of gas that has passed through the canister and the pump and a pressure of the gas before passing through the canister and the pump; and an estimating unit configured to estimate a flow rate of the purge gas supplied to the intake passage using the specific pressure difference, wherein a flow rate of the gas pumped out from the pump is higher with a smaller pressure difference between upstream and downstream sides relative to the pump, the flow rate of the gas pumped out from the pump is higher with a higher density of the purge gas, a flow rate of the gas supplied from the canister is lower with a smaller pressure difference between upstream and downstream sides relative to the canister, the flow rate of the gas supplied from the canister is lower with a higher density of the purge gas, and the estimating unit estimates the flow rate of the purge gas while the specific pressure difference is an unchanged pressure difference, the unchanged pressure difference being a pressure at which the flow rate of the gas is not changed due to the density of the purge gas.

2. The evaporated fuel processing device as in claim 1, further comprising:

an intake adjusting valve configured to adjust an air amount introduced to the intake passage not through the purge passage; and a controller configured to control the intake adjusting valve to cause the intake adjusting valve to adjust the air amount, wherein the controller causes the intake adjusting valve to adjust the air amount such that the specific pressure difference becomes the unchanged pressure difference, and the estimating unit estimates the flow rate of the purge gas while the intake adjusting valve adjusts the air amount such that the specific pressure difference becomes the unchanged pressure difference.

3. The evaporated fuel processing device as in claim 1, further comprising:

a controller configured to control a rotational speed of the pump when the purge gas is supplied to the intake passage, wherein the estimating unit estimates the flow rate of the purge gas while the rotational speed is adjusted such that the specific pressure difference becomes the unchanged pressure difference.

4. The evaporated fuel processing device as in claim 1, further comprising:

a control valve disposed on the purge passage and configured to switch between a state of closing the purge passage and a state of opening the purge passage; and a controller configured to adjust an aperture of the control valve when the purge gas is supplied to the intake passage, wherein a flow rate of gas passing through the control valve is higher with a larger aperture, and the flow rate of gas passing through the control valve is lower with a lower density, and the estimating unit estimates the flow rate of the purge gas while the aperture is adjusted to an aperture with which the flow rate of the gas is not changed due to the density.

5. The evaporated fuel processing device as in claim 1, wherein the estimating unit calculates a concentration of the evaporated fuel included in the purge gas using an estimated flow rate of the purge gas.

* * * * *